US005155965A

United States Patent [19]

Tabei et al.

[11] Patent Number: 5,155,965

[45] Date of Patent: Oct. 20, 1992

[54] METHOD OF REPAIRING CRACKS

[75] Inventors: Kazuhiko Tabei, Ashikaga; Shigeo Shimizu, 3-408, 109-93, Ryohbetsusho, Sashiohgi, Omiya-shi, Saitama-ken, both of Japan

[73] Assignees: Mitsubishi Materials Corporation, Tokyo; Shigeo Shimizu, Omiya, both of Japan

[21] Appl. No.: 613,556

[22] PCT Filed: Mar. 15, 1989

[86] PCT No.: PCT/JP89/00278

§ 371 Date: Nov. 15, 1990

§ 102(e) Date: Nov. 15, 1990

[87] PCT Pub. No.: WO90/10771

PCT Pub. Date: Sep. 20, 1990

[51] Int. Cl.[5] ..... F03G 7/06

[52] U.S. Cl. ..... 52/744; 60/527; 156/94; 52/743; 52/173 R; 52/514

[58] Field of Search ..... 52/743, 744, 173 R, 52/514; 156/94; 60/527

[56] References Cited

U.S. PATENT DOCUMENTS

| | | | |
|---|---|---|---|
| 3,734,348 | 5/1973 | White . | |
| 4,120,128 | 10/1978 | Pauls | 52/744 |
| 4,622,085 | 11/1986 | Yamada et al. | 156/94 |
| 4,811,564 | 3/1989 | Palmer | 60/527 |

FOREIGN PATENT DOCUMENTS

| | | |
|---|---|---|
| 3335487 | 2/1985 | Fed. Rep. of Germany . |
| 3511418 | 2/1986 | Fed. Rep. of Germany . |
| 54128805 | 10/1979 | Japan . |
| 5821541 | 2/1983 | Japan . |
| 5981781 | 6/1984 | Japan . |
| 60119387 | 6/1985 | Japan . |
| 60209673 | 10/1985 | Japan . |
| 61225471 | 10/1986 | Japan . |
| 62215773 | 9/1987 | Japan . |

*Primary Examiner*—David A. Scherbel
*Assistant Examiner*—Wynn E. Wood
*Attorney, Agent, or Firm*—Cushman, Darby & Cushman

[57] ABSTRACT

The invention discloses a method of repairing cracks, which is characterized in that, in injecting a repairing agent such as resin or the like into cracks occurring in an object to be repaired such as concrete, a masonry joint or the like, injection pressure of the repairing agent gradually increases after start-up of injection of the repairing agent and, further, the injection pressure is maintained substantially constant for a predetermined period of time after the injection pressure has reached a predetermined pressure, whereby the repairing agent is sufficiently spread into the cracks. Furthermore, the invention discloses a method of repairing cracks, in which the crack cavities are evacuated simultaneously with injection of the repairing agent, whereby the repairing agent is filled up in the cracks further efficiently.

7 Claims, 6 Drawing Sheets

METHOD OF REPAIRING CRACKS

FIELD OF THE INVENTION

This invention relates to a method of injecting a repairing agent into cracks occurring in concrete or a base rock, a masonry joint of brick masonry and rock masonry, or the like, to repair the cracks.

BACKGROUND ART

As known well, concrete is a composite material which utilizes the fact that, when water is added to gravel, sand and cement and is kneaded together with the latter, the water and the cement are hardened under hydration reaction. Since the concrete is long in durability, and is high in strength and, further, is low in cost, the concrete is widely used in various fields. Particularly, the concrete is a material which is essential for buildings and civil engineering construction. However, the concrete alone is extremely low in bending strength and tensile strength, and cannot sufficiently stand up against a bending force and a tensile force. In order to strengthen or reinforce this disadvantage, a method has been invented which utilizes concrete reinforced with steel products. It is the existing condition that the compound of the concrete and the steel products is widely utilized for many buildings as reinforced concrete or steel concrete.

It cannot be avoided that, as a basic property of the concrete dry shrinkage occurs due to evaporation of excess mixed water during hardening, and many minute cracks are generated at various locations. The cracks per se are elucidated in view of structural mechanics, to be of no problem. However, secondary influences caused by the cracks, for example, leaking of rain in a concrete building, corrosion or erosion of reinforcement due to leaking water from cracks, reduction in structural strength caused by the corrosion, and the like, are so serious as to down grade a material value of the concrete. Accordingly, when cracks occur in the concrete or the reinforced concrete, it is essential to repair the cracks. Conventionally, the following repairing methods are employed.

Repairing methods normally practiced conventionally are divided broadly into two categories, depending upon the size or dimension of the cracks.

The first method is one which is employed in the case where crack width is relatively wide such as those above a value of the order of 1 mm, and a repairing material can easily be poured into the cracks. In the method, a concrete surface is cut out in the form of a letter x or x along the cracks, a repairing agent such as cement milk, mortar or the like is poured into the cracks by the use of a simple appliance and, subsequently, the cut-out portions are filled up by cement mortar or resin mortar, to repair the cracks.

The second method is one in which various injection appliances are used to inject, under pressure, a repairing agent such as resin or the like into cracks. The method is utilized in the case where the crack width is of the order of 1 mm or less, and the repairing material like one described above cannot easily be poured into the cracks. In this case, the narrower the crack width, and the deeper the depths of the cracks, the larger the injection resistance. Accordingly, various appliances are used which are so contrived that elastic springs, hydraulic pressure or pneumatic pressure, or rubber elasticity is utilized to produce a predetermined injection pressure. Various examples of the appliances are shown in FIGS. 12 through 15.

An appliance illustrated in FIG. 12 is one in which an elastic force of a rubber tube is utilized to produce injection pressure. The arrangement is such that a resin (a repairing agent) 2 is forced into a rubber tube 1 by a grease pump to inflate the rubber tube 1 like a balloon, and a contractile force of the rubber tube 1 causes the resin 2 to be injected into the cracks.

An appliance illustrated in FIG. 13 is one which is arranged such that a resin is put in a cylinder 3 in the form of an injector or syringe made of a plastic material, and a contractile force of rubber straps 4 and 4 causes a piston to be pushed into the cylinder to inject the resin.

An appliance illustrated in FIG. 14 is one which is arranged such that a pressure tank 6 having a check valve 5 is mounted on cracks, resin 2 is injected into the pressure tank 6 by a grease pump 7 to increase or raise air pressure within the pressure tank 6, and the air pressure causes the resin 2 to be injected into the cracks.

An appliance illustrated in FIG. 15 is one which is arranged such that an elastic spring 10 is arranged at a rear portion of an internal pressurizing plug 9 of a cylinder 8 in the form of a syringe, a lever 11 connected to the internal pressurizing plug 9 is pulled back end to draw the resin 2 into the cylinder 8 and, simultaneously, the elastic spring 10 is contracted, and an elastic repelling force of the elastic spring 10 causes the pressurizing plug 9 to be pushed forwardly to inject the resin 2 into the cracks.

In addition to the above-described appliances, there is such an arrangement or the like that a capsule having put a resin is placed in a pressure vessel or container, is set, and compressed air is delivered into the pressure container by a compressor, thereby compressing the capsule to push the resin out thereof.

As described above, in the case where the crack width is large, it is possible to relatively easily pour the repairing agent such as the cement milk or mortar into the cracks and, thus, it is possible to easily repair the cracks. Generally, however, the cracks occurring in the concrete include many small ones equal to or less than 1 mm. On occasion, there are minute cracks of the order of a few micrometers. Accordingly, it is not necessarily easy to completely repair the minute cracks.

That is, in that case, the various appliances described above are used to inject the resin into the cracks. In order to practice complete injection, however, injection pressure larger than the injection resistance must be maintained for a long period of time. Further, since the injection resistance increases in proportion to the length of the cracks and the depth thereof, it is required that the injection pressure increases gradually. This is apparent from the Bernoulli theorem.

For the conventional method in which the above-described appliances are employed to inject the resin into the cracks, it is impossible to maintain of the injection pressure for long period of time and to increase the injection pressure gradually afterwards. Accordingly, it is impossible for any of the above-described appliances to sufficiently inject the resin into the cracks.

That is, in view of the mechanism for generating the injection pressure, all of the above-described appliances are characterized in that the injection pressure is maximum at the initiation point of injection, subsequently, is gradually reduced and, at last, approaches 0 (zero). Thus, it is impossible to retain the injection pressure necessary for the injection. For example, in the appliance illustrated in FIG. 12, the pressure within the rubber tube is maximum before the start-up of injection. When the injection starts and the quantity of the resin 2 within the rubber tube 1 decreases, the injection pressure is attenuated rapidly. This is the behavior which is against the injection theory in which the injection pressure must gradually increase. For the use of such appliance, it is impossible to practice complete injection. For the appliances illustrated in FIGS. 13 through 15, the circumstances are identical with the above ones.

The behavior of the conventional various appliances will be described in further detail with reference to FIG. 16. The abscissa in FIG. 16 indicates "a lapse of time from the start-up of injection or an injection length", while the ordinate indicates "the injection pressure of the appliance" and "the requisite injection pressure". The reference numeral 20 denotes a linear variation of the injection pressure in the conventional appliance, and the reference numeral 21 denotes a line indicating a varying condition of requisite injection pressure which is required for practicing complete injection.

In the figure, in the conventional appliance, the injection pressure is maximum at the point of time of injection start-up and, subsequently, is gradually attenuated. It is indicated, however, that the requisite injection pressure must gradually increase, conversely. It will be seen that, in spite of the fact that the injection pressure indicated by a point b is required at a point b', the use of the conventional appliance enables only injection pressure of almost 0 (zero) to be produced at the point b'. Further, the total energy required for practicing complete injection is indicated by an area enclosed by O-b-b', while the total energy generated by the conventional appliance is indicated by an area enclosed encircled by c-b'-O. In the case where the maximum injection pressure c of the appliance is equal to the requisite maximum injection pressure b, the total energy required for complete injection and the total energy generated by the appliance become equal to each other. Since, however, the injection requirements and the appliance capabilities are incompatible, half of the energy generated by the appliance is wastefully consumed. The energy used as the effective injection energy is only the area enclosed by O-a-b'. Since the energy encircled by O-c-a is generated at a stage which is not required for injection, not only the energy enclosed by O-c-a is not totally utilized effectively, but also bad effects are caused, such that the crack width is widened or, the concrete at the loosened crack portion falls off, and so on.

In the case where the conventional appliance is used, the complete injection cannot be practiced even if an appliance is used which can generate pressure equivalent to the injection pressure required for practicing the complete injection. That is, even if an appliance of 4 Kg of the conventional system when the maximum injection pressure is required by 4 Kg, repair cannot be practiced with respect to cracks in which the maximum requisite injection pressure is 4 Kg. In order to practice complete injection by the conventional appliance, the latter must be arranged such that the requisite injection pressure is produced at the final point in time. In the appliance, however, not only the maximum injection pressure becomes excessive at the time of injection start-up so that the bad influence like those described above occurs, but also the appliance must be large-sized in order to generate such large injection pressure. Large-sizing of the appliance causes handling problems, and causes large danger to be attended with. Thus, the appliance is not practical.

Furthermore, in the case where the above-described conventional appliances are used, it is possible to raise the injection pressure by addition of hydraulic pressure or by addition of a quantity of air. To this end, however, intervention of man power will be required and the injection operation becomes troublesome. This is also not practical.

In connection with the above, in FIG. 16, the varying condition of the requisite injection pressure is indicated in a straight line manner. In practice, however, the varying condition of the requisite injection pressure does not necessarily become linear attendant upon a change in the frictional resistance between the crack width and the periphery, and the varying condition of the injection pressure generated by the appliance does not become linear depending upon the structure or construction of the appliance. In either case, however, such a condition cannot be fulfilled that the maximum injection pressure is required immediately after injection start-up. Further, it is out of the bounds of possibility that, in the conventional appliance, the injection pressure becomes maximum at the final point in time.

Disadvantages of the repairing method, which utilizes the conventional appliances, will be summarized below:

1. The generation behavior of the injection pressure is opposite to the required condition of variation in pressure required for injection, and this is illogical.

2. In order to retain the injection pressure constant to practice complete injection, intervention due to man power is always required so that it is impossible to eliminate or reduce labor.

3. In order to produce high injection pressure, a complicated and large appliance is required, and special skilled laborers are always required.

4. Since the injection pressure cannot be maintained for a long period of time, it cannot be confirmed that injection becomes incomplete due to shortage or insufficiency of the injection pressure. In connection with the above, the above is applicable not only to the case where cracks generated in the concrete are repaired, but also equally to the case where repair is made to cracks in a base rock, and to cracks occurring in stone or brick, or in a masonry joint of a concrete block building.

SUMMARY OF THE INVENTION

An object of the invention to provide a method capable of reasonably and completely practice repairing of cracks which occur in concrete, a masonry joint or the like.

The invention is characterized in that, in injecting a repairing agent such as a resin or the like into cracks occurring in an object to be repaired such as concrete, a masonry joint or the like, an injection appliance is used which comprises a driving source made of a shape-memory alloy to inject the repairing agent into the cracks by a shape restoring force of the shape-memory alloy, whereby injection pressure of the repairing agent into the cracks gradually increases after the injection has started, and from the time the injection pressure reaches maximum, and the maximum injection pressure is maintained for a predetermined period of time. It is desirable that injection of the repairing agent into the cracks by the injection appliance is practiced while evacuating to exclude such objects such as water, air and so on within the cracks from the interiors of the cracks.

The injection appliance for the repairing agent, which is employed in the invention, is one in which the injection pressure is produced by utilization of the shape restoring force of the shape-memory alloy.

Many alloys indicating shape-memory effects are known. As representative alloys, there are a Ni-Ti alloy, a Cu-Al-Ni alloy, a Cu-Zn-Al alloy and the like.

The shape memory effects are based on the thermoelasticity martensitic transformation. Normally, the shape memory effects are produced by rapid-cooling of these alloys from a range of the austenitic phase or $\beta$ phase. Mechanical characteristics of the shape-memory alloy depend upon temperature, and change at the transformation temperature. The shape-memory alloy is soft under a condition of a martensitic phase at temperature equal to or below the transformation temperature, while the strength and hardness of the shape-memory alloy increase in the $\beta$ phase at temperature equal to or above the transformation temperature. Since the shape-memory alloy has such properties, a large restoring force is generated when deformation is applied to the shape-memory alloy under the condition of the martensitic phase and heating causes the shape-memory alloy to be brought to the $\beta$ phase to restore the shape of the shape-memory alloy. For example, the maximum restoring force reaches 35 $Kg/mm^2$ for the Cu-Zn-Al alloy.

The shape restoring force is determined by the degree of deformation, a quantity of shape recovery, heating temperature and the like which are given to the martensitic phase. Considering the effects of temperature, the higher the treatment temperature above the transformation temperature, the more the shape restoring force increases. Further, since the memory alloy per se has a predetermined or constant volume, some time is more or less required for reaching the ambient temperature. In either case, since the temperature does not rise instantly, the shape restoring force gradually increases. In the case where the surrounding temperature is constant, a generated force becomes a function of time. Furthermore, after the temperature has reached a predetermined value so that the shape is restored, the restoring force is always maintained so long as the temperature is not lowered.

PREFERRED EMBODIMENTS OF THE INVENTION

Figure 1:
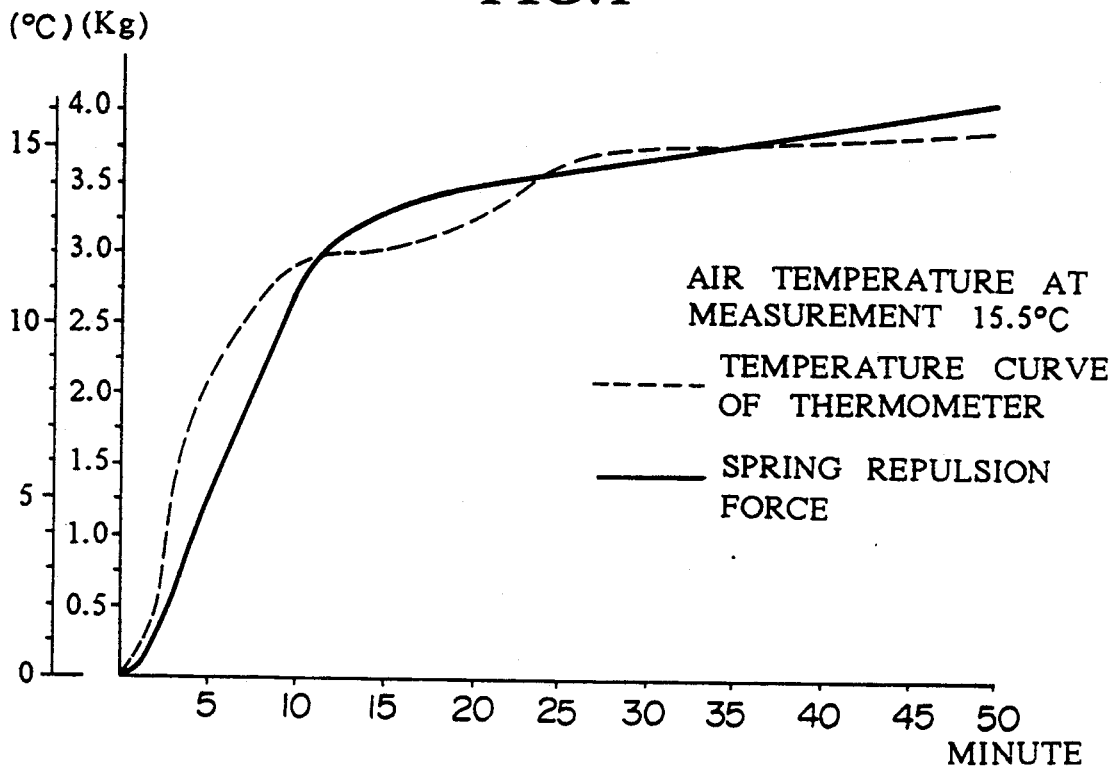
FIG. 1 is a view showing a force generating condition when a coil spring made of a shape-memory alloy is heated.

The principle of the invention will be described below with reference to FIGS. 1 and 2. An example of the force generating behavior of a shape- memory alloy is shown in FIG. 1, which shows a stress generating curve and a temperature change curve at the time a coil spring (transformation temperature is about 0° C.) made of a shape-memory alloy of a copper, zinc and aluminum system (Zn: 20 wt %, and Al: 6 wt %) is cooled to −18° C. to be contracted, and is allowed to warm up naturally to the ambient temperature (temperature is 15.5°) so that the coil spring is extended. The coil spring has its wire diameter of 3.5 mm, a coil outer diameter of 27.4 mm at contraction and 26.8 mm at extension, a length at contraction of 31.2 mm at −18° C. and a free elongation length of 80.5 mm at 15.5° C. (all of them are actually measured mean values). From this figure, it will be seen that, in the force generating condition, the stress is initially 0 (zero), but gradually increases as the temperature rises, and the stress is continuously maintained after the stress has reached maximum.

Figure 16:
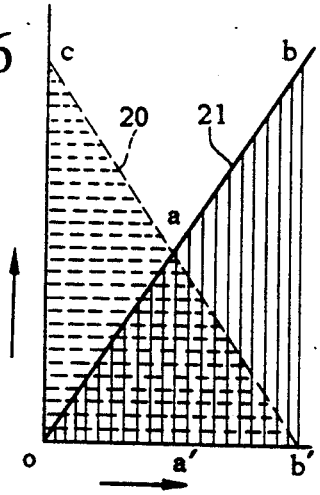
FIG. 16 is a view showing a relationship between an injection pressure generating condition of the conventional appliance and a varying condition of requisite injection pressure.

In the injection appliance in which the shape restoring force of the shape-memory alloy is utilized to inject the repairing agent, the above-described disadvantages of the conventional appliances can effectively be resolved. That is, in the case where the coil spring having its characteristics illustrated in FIG. 1 is employed, the generating condition of the stress shows a tendency similar to a changing curve 21 of a requisite injection pressure shown in FIG. 16. Accordingly, when the shape-memory alloy, which generates the stress in such a way, is utilized as a generating source of the injection stress, ideal injection can be practiced conveniently.

This will be further described with reference to FIG. 2. In FIG. 2, similarly to FIG. 16, the abscissa indicates "a lapse of time from the start-up of injection or an injection length", while the ordinate indicates "the injection pressure of the appliance" and "the requisite injection pressure". The reference numeral 25 denotes a curve showing a changing condition of the injection pressure of an appliance which employs the coil spring made of the shape-memory alloy, and the reference numeral 21 denotes a straight line (identical with the straight line 21 shown in FIG. 16) showing the changing condition of the requisite injection pressure. From this figure, it will be seen that the straight line 21 showing a change in the requisite injection pressure and the stress generating rising curve 25 of the shape-memory alloy have no substantial difference therebetween. Accordingly, there is almost no waste in energy, and ideal complete injection can be realized.

Figure 2:
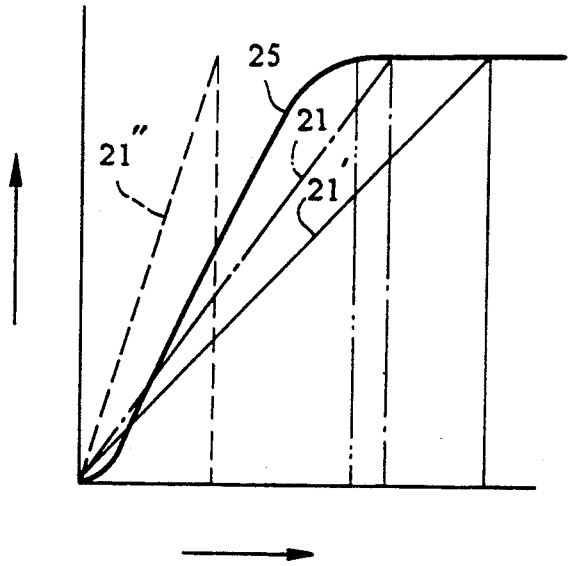
FIG. 2 is a view showing a relationship between the force generating condition and a varying condition of requisite injection pressure.

In connection with the above, the change in the requisite injection pressure is different from the straight line indicated by 21, for example, in the case where the requisite injection pressure changes under conditions indicated by the reference numerals 21' and 21" in FIG. 2, complete injection can similarly be done. That is, in the case where the requisite injection pressure changes like 21', the injection pressure of the coil spring has already reached the maximum requisite pressure at the time the maximum requisite pressure is required, and the pressure is maintained as it is. Thus, the requisite injection pressure and energy are naturally produced so that complete injection can be done. Further, in the case where the requisite injection pressure changes like 21", the injection pressure of the coil spring still does not reach the pressure at the point of time the maximum requisite pressure is required. When the predetermined time elapses, however, the injection pressure of the coil spring reaches the maximum desired pressure and, subsequently, the pressure is maintained as it is. Accordingly, only the point of time of completion of injection will more or less be delayed, but there is no change in achievement of complete injection.

Embodiments of the invention will be described below with reference to the drawings.

First, with reference to FIGS. 3 through 8, injection appliances A, B and C will be described which are suitable in use in the method according to the invention. The injection appliances A, B and C are constructed such that each of them is provided with a driving source made of a shape-memory alloy, and resin as a repairing agent is injected into cracks by a restoring elastic force of the driving source.

Figure 3:
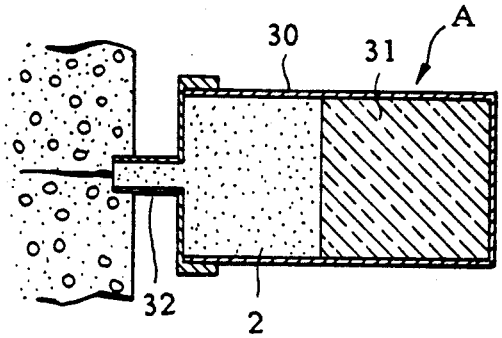
FIG. 3 is a view showing an example of an injection appliance used in the invention, and is a cross-sectional view when a piston body is contracted.
Figure 4:
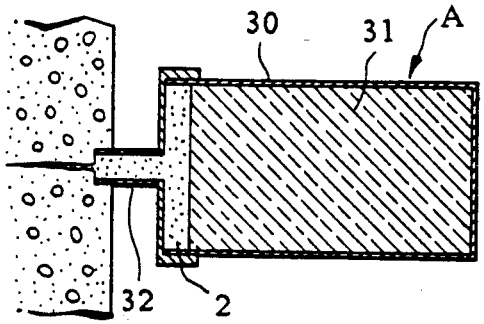
FIG. 4 is a view showing the example of the injection appliance used in the invention, and is a cross-sectional view when the piston body is extended or lengthened.

The injection appliance A schematically shown in FIGS. 3 and 4 is arranged such that a piston body (driving source) 31 made of a shape-memory alloy is mounted within a cylinder 30, and is extended when the piston body 31 is heated to temperature equal to or higher than the transformation temperature. As illustrated in FIG. 3, after the piston body 31 has been cooled to temperature equal to lower than the transformation temperature and has been contracted, the repairing agent, the resin 2, is filled within the cylinder 30. After an injection port 32 at the forward end of the cylinder 30 is mounted to an injection location, the piston body 31 is heated to temperature equal to or higher than the transformation temperature. By doing so, as illustrated in FIG. 4, the piston body 31 tends to be returned and extended to a condition which is memorized by the piston body 30, whereby the resin 2 is pushed out and injected into the cracks. In this injection appliance, since the quantity of deformation of the piston body 31 is small, the quantity of injection is small. However, high injection pressure can be produced.

Figure 5:
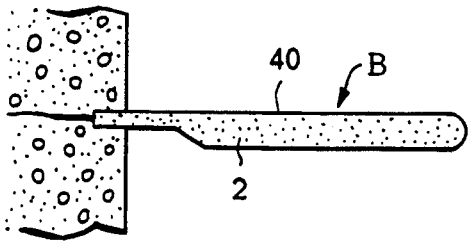
FIG. 5 is a view showing another example of an injection appliance used in the invention, and is a cross-sectional view of a condition in which a container made of a shape-memory alloy is extended.
Figure 6:
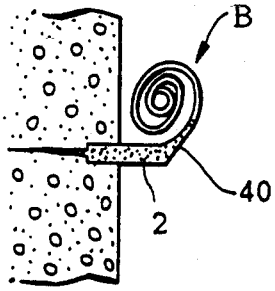
FIG. 6 is a view showing another example of the injection appliance used in the invention, and is a cross-sectional view of a condition in which the container is deformed into a spiral form.

Next, the injection appliance B illustrated in FIGS. 5 and 6 is arranged such that a container 40 in the form of a toothpaste tube is made of a shape-memory alloy, and is brought to a driving source in which, when the container 40 per se is heated to temperature equal to or higher than the transformation temperature, the container 40 is returned to a condition in which the container 40 is spirally wound. After the container 40 has been cooled and extended and the resin 2 has filled in the container 40, the forward end of the container 40 is mounted to the injection location. Subsequently, the container 40 is heated, whereby the container 40 i deformed into the memorized spiral configuration illustrated in FIG. 6, so that the resin 2 is squeezed out.

Figure 7:
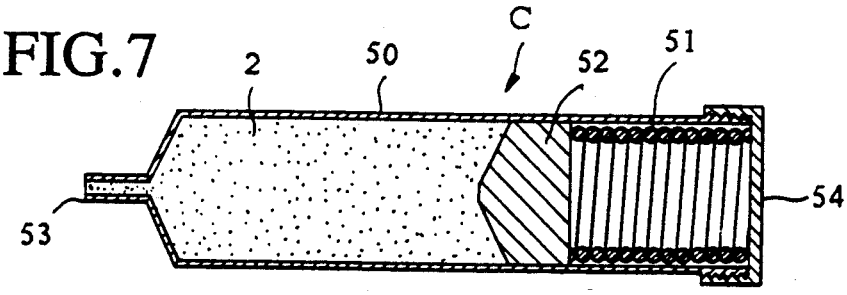
FIG. 7 is a view showing still another example of an injection appliance used in the invention, and is a cross-sectional view of a condition in which a coil spring is contracted.
Figure 8:
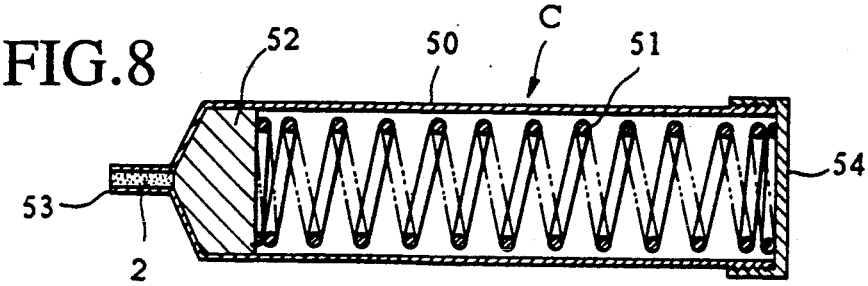
FIG. 8 is a view showing the still another example of the injection appliance used in the invention, and is a cross-sectional view of a condition in which the coil spring is extended.

Further, the injection appliance C illustrated in FIGS. 7 and 8 is constructed such that a coil spring (driving source) 51 made of a shape-memory alloy in which, when the coil spring 51 is heated, the coil spring 51 is lengthened and is returned to its memorized condition, is arranged within a cylinder 50 in the form a syringe. The arrangement is such that, after the coil spring 51 has been cooled and contracted, the resin 2 is filled in the cylinder 50 as illustrated in FIG. 7, and when the coil spring 51 is heated, the coil spring 51 is extended as shown in FIG. 8 to push a piston 52 forwardly. In this connection, the reference numeral 53 denotes an injection port provided at the front, end of the cylinder 50, and the reference numeral 54 denotes a back end cap.

In addition to the injection appliances, injection appliances having various constructions can be considered. However, the injection pressure of these appliances which all utilize the shape restoring force of the shape-memory alloy varies in accordance with the curve as shown in FIG. 1. When the shape-memory alloy is heated to temperature equal to or higher than the transformation temperature, the injection pressure of the resin 2 gradually increases. After the injection pressure has reached the maximum injection pressure, the shape-memory alloy maintains that condition as it is, as far as the shape-memory alloy is not cooled to temperature equal to or lower than the transformation temperature.

In connection with the above, the transformation temperature of each of the driving sources in the above-described injection appliances A, B and C, that is, the piston body 31, the container 40 or the coil spring 51 may optionally be set. If, however, the transformation temperature is set to one equal to or lower than the ordinary temperature, the shape restoring force can naturally be produced only by natural heating due to the atmospheric temperature and the injection pressure is maintained so long as cooling is not forced.

Figure 9:
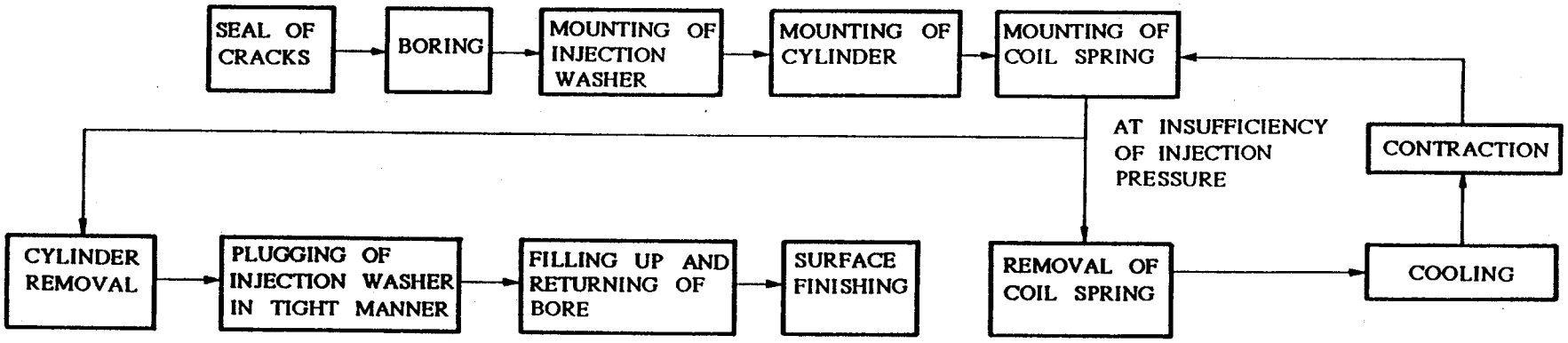
FIG. 9 is a view showing an embodiment of a method according to the invention, and is a flow chart of operation and procedure.
Figure 10A:
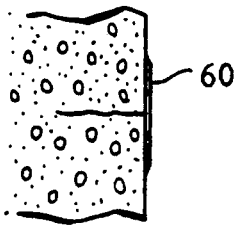
FIGS. 10(*a*) through 10(*d*) are views showing an embodiment of the method according to the invention, and are views showing principal procedure in order of operational steps.
Figure 10B:
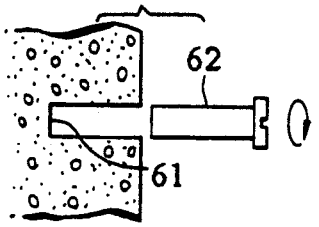
Figure 10C:
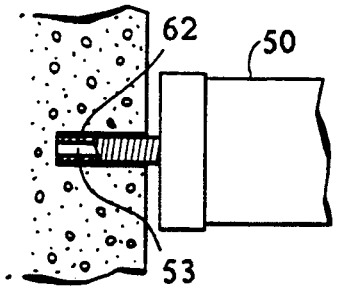
Figure 10D:
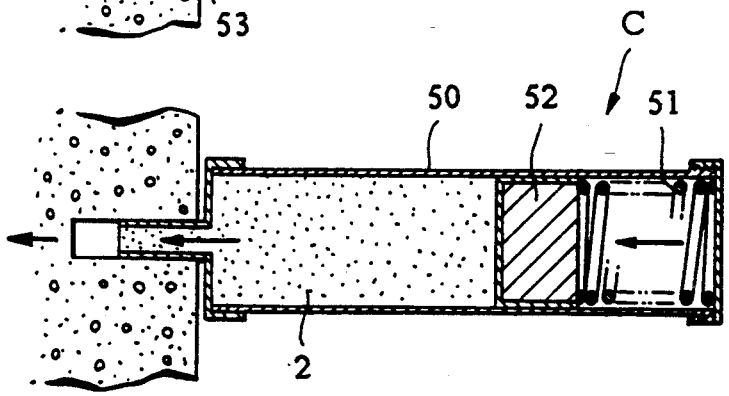

Operational procedure in the case where the injection appliance C illustrated in FIGS. 7 and 8 is used to inject the resin into cracks occurring in concrete to repair the cracks will be described with reference to FIGS. 9 and 10. In this case, the transformation temperature of the coil spring 51 is set lower than the ambient temperature. In this connection, 1 through 9 in the following description correspond respectively to the marks 1 through 9 in the flow chart illustrated in FIG. 9.

1. First, as shown in FIG. 10(*a*), a cement water-damming agent and a seal material 60 of epoxy resin are used to seal surfaces of cracks. This is to prevent the injected resin from leaking out.

2. A drill is used from a location above the sealed cracks, to form a bore 61 whose diameter is of the order of 10 mm and whose depth is of the order of 35 mm, for example, as illustrated in FIG. 10(*b*). A plurality of bores 61, . . . may be formed in line. In this case, it is preferable that intervals of these bores are made to be 20 mm through 25 mm, for example.

3. An injection washer 62 is screwed into the bore 61 drilled as described above, by the use of a screwdriver, and is mounted flush to a wall surface. It is further preferable that an adhesive agent is applied to the screw portion to screw the same into the wall surface.

4. The requisite quantity of resin 2 is filled into the cylinder 50 of the injection appliance c. As shown in FIG. 10(*c*), the injection port 53 at the forward end of the cylinder 50 is screwed into the injection washer 62 and is mounted thereto.

5. The back end cap 54 of the cylinder 50 is removed. The coil spring 51 made of the shape-memory alloy, which is beforehand cooled and contracted, is mounted to a portion within the cylinder 50 which is located in rear of the piston 52, as illustrated in FIG. 10(*d*), and the back end cap 54 is mounted to the cylinder 50 and is screwed therein. By doing so, when the coil spring 51 is heated naturally and its temperature rises higher than the transformation temperature, the coil spring 51 tends to be returned to the memorized configuration, and is gradually extended or lengthened. By doing so, the piston 52 is pushed forwardly so that the resin 2 is injected into the cracks.

6. After the resin 2 within the cylinder 50 has been injected into the cracks, the cylinder 50 is left as it is for a predetermined period of time. By doing so, the injection pressure of the coil spring 51 is maintained so that the resin 2 reaches locations deep in the cracks. Subsequently, the cylinder 50 is removed or detached from the injection washer 62.

7. A suitable check valve is screwed into the injection washer 62 to prevent the resin 2 from flowing out of the cracks.

8. A repairing agent is immediately applied to the cracks from a location above the injection washer 62 and is filled up in the neighborhood of the injection washer 62.

9. A surface of the concrete is finished.

On the basis of the above, one operation cycle has been completed. Subsequently:

10. The extended coil spring 51 is removed out of the interior of the cylinder 50.

11. The coil spring 51 is cooled to temperature equal to or lower than the transformation temperature by a suitable cooling machine.

12. Subsequently, the coil spring 51 is again contracted.

The contacted coil spring 51 is again mounted within the cylinder 50 (step of the above 5). Hereafter, the above procedure is repeated over the entire length of the cracks.

In connection with the above, in the case where sufficient injection pressure cannot be produced in the step of 5, the coil spring 51 is removed from the cylinder 50 (step 10). After the above-described steps 11 and 12 are completed, the coil spring 51 is again mounted within the cylinder 50 and the injection should be repeated.

According to the above-described method, after the coil spring 51 has been mounted to the location within the cylinder 50, the coil spring 51 is naturally heated and is extended per se so that the resin 2 is pushed out. Accordingly, an operation relying upon man power is entirely unnecessary or is entirely dispensed with. Thus, it is of course that an attempt can be made to save energy, and the injection pressure rises per se with lapse of time. Further, the injection pressure due to the coil spring 51 is maintained for a long period of time. Accordingly, it is possible to practice ideal injection which is in accord with the injection theory, making it possible to completely and reliably inject the resin 2 into the cracks up to deep locations.

In connection with the above, the arrangement is such that the transformation temperature of the coil spring 51 is brought to one lower than the ordinary temperature, and the coil spring 51 is returned to its memorized condition and is extended when the coil spring 51 is heated naturally within the environment. However, the arrangement may be such that the transformation temperature is set to one above the ordinary temperature, and a suitable heating source is used to forcibly heat the coil spring 51. In that case, it is possible to freely control the injection pressure by adjustment of the heating temperature. In this case, if the forcible heating is interrupted to naturally cool the coil spring 51 to room temperature, it is possible to easily contract the coil spring 51. Accordingly, a cooling machine is dispensed with.

Figure 11A:
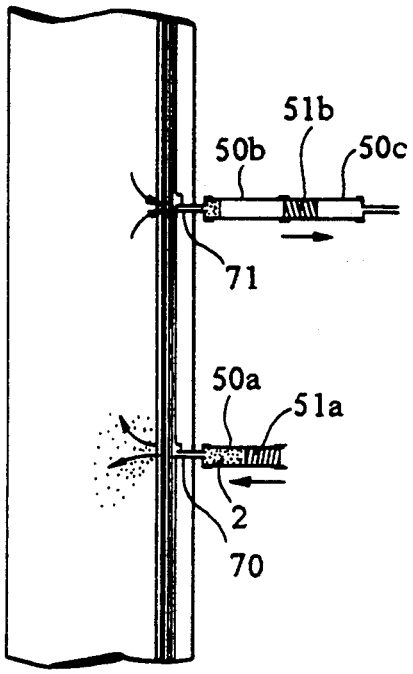
FIGS. 11(*a*) and 11(*b*) are views showing another embodiment of the method according to the invention, FIG. 11(*a*) being a view showing a condition in which injection is practiced while drawing or suction is effected, and FIG. 11(*b*) being an enlarged view of a suction cylinder.
Figure 11B:
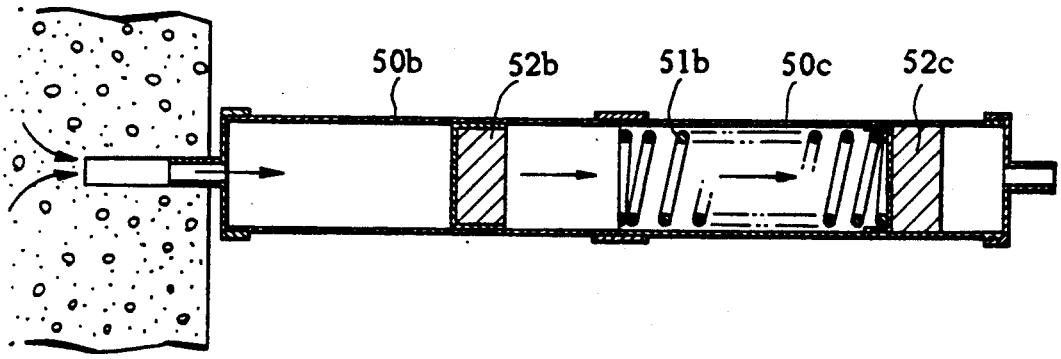
Figure 12:
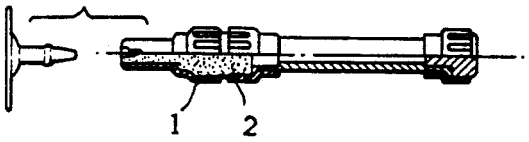
FIGS. 12 through 15 are views showing the conventional injection appliances, respectively.
Figure 14:
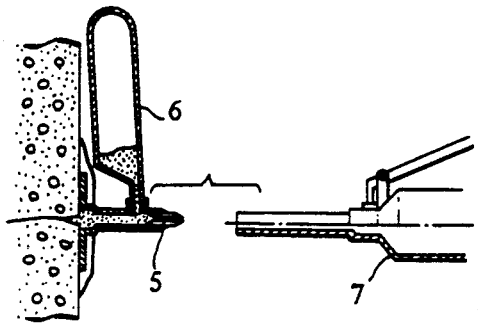
Figure 13:
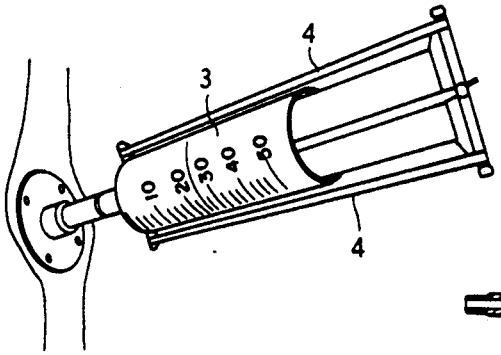
Figure 15:
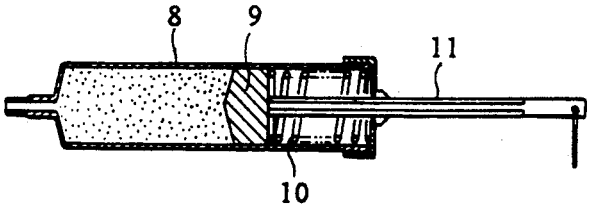

Next, an example of another repairing method, which employs the above-described appliance c, will be described with reference to FIG. 11. The method is arranged such that resin is injected into cracks while air and water content existing within the cracks are eliminated. The method is one suitable in employment in the case where a plenty of air and water content exist within the cracks and have no refuge so that sufficient resin cannot be injected into the cracks, if remaining intact. In this case, the cracks are first sealed gas-tightly, similarly to the above-described method. At least two bores 70 and 71 are formed at predetermined intervals therebetween. As shown in FIG. 11(*a*), a cylinder 50*a* having filled therein the resin 2 similarly to the above is mounted to one bore 70 of the adjacent two bores 70 and 71. An empty cylinder 50*b* is mounted to the other bore 71. As shown in FIG. 11(*b*), another cylinder 50*c* is connected, in a reverse manner, to the back end portion of the empty cylinder 50*b*. Coil springs 51*a* and 51*b*, which have been cooled and contacted, are mounted within the one cylinder 50*a* and the another cylinder 50*c* which is connected to the back end portion of the another cylinder 50*b*.

By doing so, both the coil springs 51*a* and 51*b* are naturally heated and extended. As a result, the resin 2 is pushed into the cracks from the one cylinder 50*a*, similarly to the above-described case, while a piston 52*c* within the another cylinder 50*c* connected to the back end portion of the another cylinder 50*b* is moved backwardly so that the interior of the another cylinder 50*c* is reduced in pressure. Attendant on this, the piston 52*b* within the cylinder 50*b* is also moved backwardly s that the cylinder 50*b* is reduced in pressure. By doing so, air and water content existing within the cracks are drawn into the cylinder 50*b*.

The resin 2 injected from the one cylinder 50*a* flows toward the other cylinder 50*b* through the cracks. Ultimately, the resin 2 enters the cylinder 50*b*. Thus, it is possible to confirm that the resin 2 is completely injected into the cracks between both the cylinders 50*a* and 50*b*.

Subsequently, the one cylinder 50*a* is maintained as it is for a predetermined period of time, while the cylinder 50*c* connected to the back end portion of the another cylinder 50*b* is removed therefrom. The water content flowing into the interior is removed. Subsequently, the resin 2 is filled within the cylinder 50*b*. Another coil spring 51*c* (not shown) is mounted within the cylinder.

An empty cylinder is mounted to another bore (not shown) provided adjacent the bore 71, similarly to the above, and another empty cylinder is connected to the back end portion of the cylinder. Another coil spring, which has been contracted, is mounted within the cylinder. At this time, the resin 2 is injected into the cracks from the cylinder 50*b*, while air and water content are removed from the cracks by these cylinders.

The above-described procedure is repeated, whereby, in the case where a plenty of air and water content exist within the cracks so that there is no refuge, and in the case where the cracks are long in length, it is possible to completely inject the resin into the cracks over their entirety. The injection pressure of the resin into the cracks gradually increases from the point of time of injection start-up, entirely similarly to the above-described embodiments. After completion of the injection, the large injection pressure can be maintained as it is. Accordingly, it is possible to completely practice injection of the resin into the cracks.

As described above in detail, the method according to the invention is arranged such that the driving source made of the shape-memory alloy is provided and the injection appliance is used in which the shape restoring force of the shape-memory alloy causes the repairing agent to be injected into the cracks, whereby the injection pressure of the repairing agent into the cracks gradually increases, and the maximum injection pressure is maintained for a predetermined period of time. Thus, superior advantages like ones listed below can be produced.

1. It is possible to reduce labor intensity of the injection operation.

The arrangement is such that the martensitic transformation temperature of the driving source made of the shape-memory alloy is brought to temperature lower than the ordinary temperature, and the driving source is cooled to temperature equal to or lower than the transformation temperature and is brought to a freely deformable condition, so that the injection appliance is mounted to the cracks. The driving source is heated by air temperature and is returned to the memorized configuration naturally. Attendant upon this, the injection pressure gradually increases per se and reaches the designed maximum pressure. Subsequently, the pressure is maintained. Accordingly, input operations such as manual input into the appliance as in the conventional appliance, corrective work to tend to reduction of the injection pressure, and so on are entirely dispensed with, so that the labor content of the injection operation is reduced.

2. It is possible to practice complete injection.

In the conventional method, there is a fear that, as injection proceeds, the injection pressure is attenuated as the repairing agent is pushed out of the injection appliance, it is impossible to retain the large injection pressure during injection final stage, so that the repairing agent is hardened while voids or cavities remain at the extremities of the cracks. In the invention, to the contrary, the pressure is not at all reduced even in the final injection stage, and the large injection pressure can always be maintained. Thus, it is possible to practice complete injection.

3. It is possible to optionally set the injection pressure.

In the various conventional injection appliances, it is impossible to easily alter the injection pressure. In the invention, however, since it is possible to adjust the mechanical characteristics of the driving source made of the shape-memory alloy, the injection pressure can optionally be set. Further, the driving source can be used in exchange to another driving source having different magnitudes of the shape restoring force.

4. Evacuation is made from the interiors of cracks, to practice complete injection.

In the case where air and water exist within the cracks so that there is no refuge therefrom, it is impossible to completely inject the repairing agent into the cracks completely. However, repair is made while the interiors of cracks is being evacuated, whereby it is possible to discharge air and water within the cracks so that the repairing agent can completely be injected to the extremities of cracks.

5. It is possible to improve the injection operational efficiency.

In the case where the conventional appliances is employed, it is required that an elastic spring is shortened or rubber is lengthened by man power. In the invention, to the contrary, only temperature is controlled to enable the shape restoring force of the driving source to be produced. Further, only cooling of the driving source to temperature equal to or lower than the transformation temperature enables the driving source to be deformed freely and easily. Accordingly, it is possible to reduce the labor of an operator and the energy consumption to greatly improve the operational efficiency.

6. Safety is extremely high.

In the case where the conventional appliance is used, since it is required to extend or stretch and retract the elastic spring and rubber by man power, and since the pneumatic pressure and hydraulic pressure are employed, danger will be accompanied with accidental injuries or the like. In the case of the invention, to the contrary, since the shape restoring force cannot be generated unless the temperature varies, and since the generating condition is also slow, there is totally no case where danger is exerted upon the operator even in the case where an appliance generating large injection pressure is used.

7. Injection under high pressure can easily be done.

Since man power input is not required, and since only control of temperature enables high injection pressure to be produced, the repairing agent can be injected under high pressure without the necessity of complicated devices, complex equipment and skilled manpower.

We claim:

1. A method of repairing cracks, wherein a repairing agent is forcibly injected into cracks occurring in an object to be repaired, the method comprising the steps of:

(a) gradually increasing injection pressure of the repairing agent after start-up of injection of said repairing agent; and (b) maintaining said injection pressure substantially constant for a predetermined period of time, after said injection pressure has reached a predetermined pressure; wherein the gradual increasing of said injection pressure and the maintaining of said predetermined pressure are achieved by a restoring force of a shape-memory alloy.

2. The method of repairing cracks, according to claim 1, wherein said shape-memory alloy, which was strained at temperature not more than a transformation temperature, is raised to temperature above the transformation temperature, thereby exhibiting said restoring force.

3. The method of repairing cracks, according to claim 2, wherein the transformation temperature of said shape-memory alloy is not more than the ambient temperature, and wherein said shape-memory alloy was strained at a temperature not higher than the transformation temperature, is raised to a temperature by the ambient temperature, thereby exhibiting the restoring force.

4. The method of repairing cracks, according to claim 2, wherein said shape-memory alloy, which was strained at a temperature not higher than the transformation temperature, is raised in temperature by an heating device, thereby exhibiting the restoring force.

5. The method of repairing cracks, according to claim 2, wherein said shape-memory alloy is configured as a coil spring.

6. The method of repairing cracks, according to claim 2, wherein said shape-memory alloy is configured as a container, and wherein said repairing agent is contained in said container.

7. A method of repairing cracks, wherein a repairing agent such as resin or the like is forcibly injected into cracks occurring in an object, the method comprising the steps of:

(a) gradually increasing injection pressure of the repairing agent after start-up of injection of said repairing agent;

(b) maintaining said injection pressure substantially constant after said injection pressure has reached predetermined pressure; wherein the gradual increasing of said injection pressure and the maintaining of said predetermined pressure are achieved by a restoring force of a shape-memory alloy; and (c) evacuating said cracks simultaneously with injection of said repairing agent, thereby discharging at least some of the substances existing within the cracks.

* * * * *